US005794903A

United States Patent [19]

Peterson, II

[11] Patent Number: 5,794,903

[45] Date of Patent: Aug. 18, 1998

[54] SECURING APPARATUS

[76] Inventor: Max R. Peterson, II, 6563 River Clyde Dr., Highland, Md. 20777

[21] Appl. No.: 665,979

[22] Filed: Jun. 19, 1996

[51] Int. Cl.[6] ..... F16M 13/00; A47B 96/06

[52] U.S. Cl. ..... 248/300; 248/544; 248/547; 248/345.1; 248/684; 248/687

[58] Field of Search ..... 248/300, 544, 248/547, 345.1, 687, 684

[56] References Cited

U.S. PATENT DOCUMENTS

| | | | |
|---|---|---|---|
| 2,111,034 | 3/1938 | Porwoll | 72/105 |
| 2,125,770 | 8/1938 | Dabroski | 248/547 X |
| 2,126,630 | 8/1938 | Gleitsman | 248/547 |
| 2,521,134 | 9/1950 | Stanitz | 248/224 |
| 2,708,147 | 5/1955 | Duggan et al. | 312/111 |
| 2,733,887 | 2/1956 | Schmidt | 248/223 |
| 2,830,863 | 4/1958 | Fehr, Jr. | 312/245 |
| 2,931,686 | 4/1960 | Afdal | 312/245 |
| 3,294,356 | 12/1966 | Sherman | 248/547 X |
| 3,345,029 | 10/1967 | Palmer | 248/547 X |
| 3,350,787 | 11/1967 | Romano | 248/544 X |
| 3,530,591 | 9/1970 | Moffitt | 248/544 X |
| 3,946,979 | 3/1976 | Ehlebracht et al. | 248/274 |
| 3,950,049 | 4/1976 | Drass | 312/245 |
| 3,989,215 | 11/1976 | Weston | 248/224 |
| 4,133,507 | 1/1979 | Chervenak | 248/225.2 |
| 4,270,821 | 6/1981 | Verdesca | 312/245 |
| 4,329,003 | 5/1982 | Manchester | 312/245 |
| 4,342,439 | 8/1982 | Bruner | 248/544 |
| 4,576,355 | 3/1986 | Graf | 248/544 |
| 4,669,695 | 6/1987 | Chou | 248/500 |
| 4,863,132 | 9/1989 | Fitzgerald et al. | 248/274 |
| 4,890,813 | 1/1990 | Johnson et al. | 248/680 |
| 4,928,913 | 5/1990 | Laughon et al. | 248/224.1 |
| 4,949,929 | 8/1990 | Kesselman et al. | 248/300 |
| 5,014,946 | 5/1991 | Gruber | 248/206.5 |
| 5,050,832 | 9/1991 | Lee et al. | 248/225.2 |
| 5,076,525 | 12/1991 | Whipple | 248/300 |
| 5,152,593 | 10/1992 | Domenig | 312/245 |
| 5,174,543 | 12/1992 | Corson et al. | 248/680 |
| 5,176,437 | 1/1993 | Remington | 312/351.1 |
| 5,192,123 | 3/1993 | Wallin | 312/351.7 |
| 5,209,449 | 5/1993 | Hart | 248/544 X |
| 5,222,611 | 6/1993 | Wood et al. | 211/94 |
| 5,454,542 | 10/1995 | Hart | 248/547 X |

*Primary Examiner*—Daniel P. Stodola
*Assistant Examiner*—Tina R. Taylor
*Attorney, Agent, or Firm*—Aquilino & Welsh

[57] ABSTRACT

An apparatus for securing freestanding objects to a support surface. The apparatus includes an elongated member having a first leg connected to a second leg such that the first leg is substantially perpendicular to the second leg. The first leg includes a first longitudinal axis along which at least one hole is formed in the first leg at a predetermined location permitting the apparatus to be secured to the freestanding object. The second leg includes a second longitudinal axis, parallel to the first longitudinal axis, along which at least one hole is formed in the second leg at a predetermined location permitting the apparatus to be secured to the support surface.

12 Claims, 2 Drawing Sheets

SECURING APPARATUS

BACKGROUND OF THE INVENTION

1. Field of the Invention

The invention relates to apparatuses for securing freestanding objects to a support surface. More particularly, the invention relates to simple, easy-to-use, non-destructive mounting brackets enabling a user to secure a piece of furniture, or other object, to a vertical surface at a desired location with respect to the vertical surface.

2. Description of the Prior Art

In the past, many devices have been designed in an attempt to secure a freestanding object to a vertical surface in a manner which is simple, safe and reliable. Unfortunately, past attempts have not met the requirements for a dependable mounting bracket. They are either too complicated for simple installation, or they do not provide adequate support for the secured object.

According to the US Consumer Product Safety Commission (CPSC) in Consumer Product Safety Alert #5004 issued in March 1990, "several deaths and thousands of injuries occurred to children when furniture tipped over. These injuries and deaths occurred when children fell against, climbed onto, or sat on furniture. They also occurred when children tried to move furniture or open or close drawers or doors". The CPSC recommends the use of angle-braces or anchors to secure furniture to a wall. However, given the frequency of injuries and deaths recorded, it is clear that common anchors and hardware are not adequately employed as preventative measures. Likewise, the prior art does not fully address the problems inherent with consumer installation and use of anchoring or securing devices.

For example, U.S. Pat. No. 4,863,132 to Fitzgerald et al. discloses a safety restraint bracket. The bracket employs bolt and wall fasteners to secure furniture to a wall. This design, however, has several drawbacks. The bracket is difficult to fasten to furniture and/or the wall (or other vertical surface). The bracket also does not anticipate the needs of modern furniture systems. For example, it lacks a leveling device to assure plumb installation, and it does not assist with facial and lateral alignment of furniture components aligned in a row. Finally, because the bracket attaches to a single point on the wall, it provides no safety mechanism for potential mechanical failure of the wall surface.

When utilizing the bracket disclosed by Fitzgerald et al., one must blindly install the support bracket behind the furniture's rear panel and into the wall against which the furniture stands. This presents multiple problems which prevent the easy, safe and non-destructive application of the device to fasten the furniture to the wall. Because the bracket utilizes multiple pieces for installation, one must drill through the rear panel of the furniture, attach a restraint assembly to the furniture, and then install a wall plate to the wall behind the furniture. This two part arrangement makes precise location and alignment difficult. The installer must correctly measure and locate the furniture bracket in such a way that when pushed against the wall, the restraint assembly aligns perfectly with the wall plate. If the measurements are off, or the floor covering thickness is not properly accounted for, the restraint assembly and the wall plate will not meet correctly. This will necessitate removing the furniture from the wall and adjusting either the wall plate or restraint assembly, or both.

A wide variety of support brackets are known in the art. For example, U.S. Pat. No. 5,174,543 to Carson et al. discloses a tipover prevention apparatus for an appliance. The apparatus includes a wall-mounted bracket having a plurality of hooks to which an appliance tether cable is attached, preventing the appliance from falling over. U.S. Pat. Nos. 2,708,147 to Duggan et al. and 5,076,525 to Whipple disclose relatively simple bracket support apparatus. However, use of these brackets is limited to objects which have been substantially modified to mate with the bracket.

The present invention overcomes the shortcomings of prior art devices by providing, for the first time, an easily used, highly secure and aesthetically pleasing non-destructive securing apparatus which is economical and practical for consumer-installed applications. The present invention permits the installation to be accomplished in less time than prior art installations, while reducing the chance that sub-optimal furniture and/or wall fastening placement will result in failure of the apparatus to properly secure the furniture. The present invention does not require destruction of any of the normally visible surfaces of the furniture and may be simply removed without leaving disfiguring marks on the furniture. The present invention permits easy leveling, allows variable distance spacing from the wall to accommodate varying thicknesses of floor moldings (for example, baseboard molding, quarter round, etc.) and wall moldings (for example, chair rail molding, picture boxes, etc.), and facilitates a tight lateral fit with proper facial alignment of multiple furniture components.

The present invention exceeds, in several important ways, the objectives of prior art devices which aimed only to secure the furniture to a vertical surface. The present invention incorporates an opening for managing electrical power cords behind the furniture so the cords do not accidentally fall behind the furniture. While allowing passage of electrical cords from behind the furniture, the present invention provides a continuous barrier which prevents objects from falling from the top rear of the furniture down into the space between the furniture and the wall. The present invention directly incorporates a measuring element (including both metric and English scales) and leveling aids into the design of the device. The present invention also incorporates adhesive backing on sides of the device which contact mounting surfaces, thereby simplifying installation. The adhesive backing is exposed by removing a protective paper layer. If adhesion to the wall surface is not desired because later removal of the device could harm wall paper or paint under the device, installation is done without removing the protective layer.

SUMMARY OF THE INVENTION

It is, therefore, an object of the present invention to provide a device for securing furniture or similar structures to a wall or other vertical surface. The device prevents the furniture from tipping over as a result of forces exerted on the front of the furniture and minor geological disturbances, enhances the appearance (i.e., level installation, facial alignment) and operation (i.e., stability of the furniture when opening doors) of furniture, and prevents loss of electrical cords and other objects behind the furniture. The device is unobtrusive in that it is installed at the top of the furniture, either along the top back edge (on closed back furniture), or on the rear underside of the top shelf (on open back furniture).

Accordingly, it is an object of the present invention to provide an apparatus for securing freestanding objects to a support surface. The apparatus includes an elongated member having a substantially L-shaped cross-section, wherein the elongated member includes a first leg connected to a second leg such that the first leg is substantially perpendicular to the second leg. The first leg includes a first longitudinal axis along which at least one hole is formed in the first leg at a predetermined location permitting the apparatus to be secured to the freestanding object. The second leg includes a second longitudinal axis, parallel to the first longitudinal axis, along which at least one hole is formed in the second leg at a predetermined location permitting the apparatus to be secured to the support surface.

It is another object of the present invention to provide an apparatus for securing freestanding objects to a support surface, wherein the first leg includes a series of evenly spaced holes formed along the first longitudinal axis permitting the apparatus to be secured at various points along the freestanding object.

It is also an object of the present invention to provide an apparatus for securing freestanding objects to a support surface, wherein the second leg includes a series of evenly spaced holes formed along the second longitudinal axis permitting the apparatus to be secured at various points along the support surface.

It is a further object of the present invention to provide an apparatus for securing freestanding objects to a support surface, wherein the series of evenly space holes in the first leg are aligned with the series of evenly spaced holes in the second leg permitting a fastening element to simultaneously pass through a hole in the first leg and a hole in the second leg for securing the apparatus to the support surface.

It is also an object of the present invention to provide an apparatus for securing freestanding objects to a support surface, wherein the second leg includes an adhesive strip, with a removable protective layer over the adhesive, on an outer surface of the second leg for temporarily securing the apparatus to the support surface while the elongated member is secured to the support surface.

It is a further object of the present invention to provide an apparatus for securing freestanding objects to a support surface, wherein the apparatus includes a leveling element.

It is another object of the present invention to provide an apparatus for securing freestanding objects to a support surface, wherein the second leg includes a projection extending away from an outer surface of the second leg ensuring that the freestanding object is properly positioned a distance from the support surface.

It is also an object of the present invention to provide an apparatus for securing freestanding objects to a support surface, wherein the apparatus includes a groove formed in the elongated member to permit an object to pass between the freestanding object and the support surface when the freestanding object is secured to the vertical surface.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
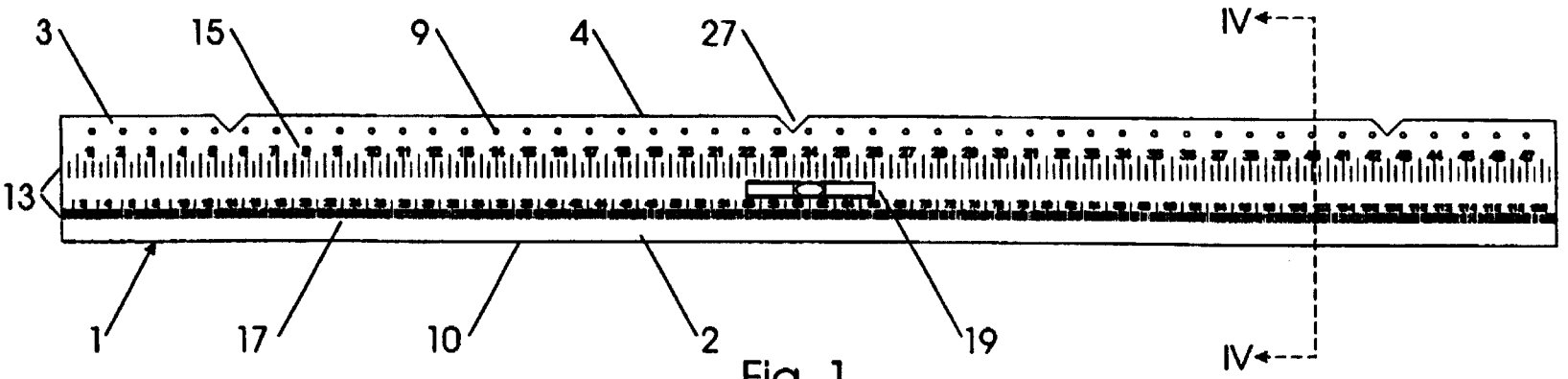
FIG. 1 is a top view of the furniture securing apparatus, showing two measuring scales, a plurality of fastening holes, a plurality of "V-shaped" cord grooves and a bubble level.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1–8, the present securing apparatus 1 is disclosed. The apparatus 1 is used to secure freestanding objects to a support surface. While the apparatus is primarily designed for securing furniture to a vertical wall, the apparatus could be employed to secure other objects to a wide variety of support surfaces.

The apparatus 1 includes an elongated member 10. The elongated member 10 is formed from a substantially rigid material, preferably plastic. For example, the elongated member could be constructed from PVC, polyethylene or polypropylene. While the elongated member 10 is preferably made from plastic, a variety of other materials, including metals, could be used without departing from the spirit of the present invention. The elongated member 10 has a L-shaped cross-section that, while providing adequate strength, is preferably capable of being cut with household tools. To conceal the device, markings similar to the furniture (for example, wood grain) and shading may be incorporated into the surface of the elongated member 10.

The elongated member 10 includes a first leg 3 and a second leg 5 oriented substantially perpendicular to each other, creating the L-shaped cross-section of the elongated member 10. The first leg 3 includes a first free edge 2 and a second edge 4. The second edge 4 is formed contiguously with the first edge 6 of the second leg.

Figure 4:
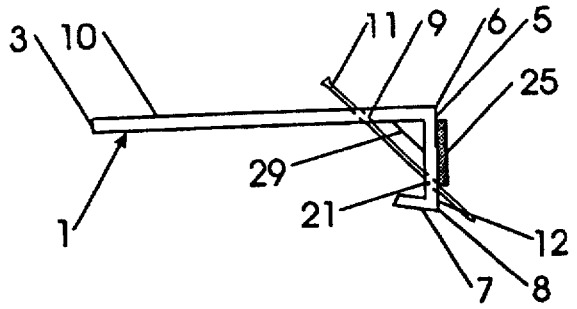
FIG. 4 is a cross sectional view of the securing apparatus along the line IV—IV in FIG. 1, showing a fastening device and an adhesive backing provided with the apparatus.

The second leg 5 includes a second edge 8. A projection 7 is secured along the second edge 8 of the second leg 5. The projection 7 extends away from the outer surface 12 of the second leg 5 and is substantially parallel to the first leg 3. The projection 7 is preferably continuous along the second edge 8 of the second leg 5. However, the projection 7 could be formed at spaced locations along the second edge 8 of the second leg 5, without departing from the spirit of the present invention. As shown in FIG. 4, the projection 7 is a straight extending member, but may take a variety of shapes while maintaining the spirit of the present invention.

The projection 7 spaces furniture from the wall to prevent inadvertent damage to the wall and provide space for positioning objects between the furniture and the wall. As such, the projection 7 may be manufactured in a variety of shapes and lengths to suit the needs of the individuals employing the apparatus.

As shown in FIG. 1 the first leg 3 includes a plurality of holes 9, evenly spaced and aligned parallel to the longitudinal axis of the first leg 3. The holes 9 pass through the first leg 3 at approximately a 45 degree angle with respect to the plane of the first leg 3. As a result, when a fastening device 11 (for example, a nail) is passed through the first leg 3, the fastening device 11 is directed such that it will pass through a hole in the second leg 5 (see FIG. 4).

The first leg 3 also includes a measuring scale 13, calibrated in both an English scale 15 and a metric scale 17. As discussed in greater detail below, an installer may use these scales when cutting the apparatus to various installation sizes to accommodate different sized furniture. The length of the device depends upon specific applications, but a nominal, manufactured length of eight to ten feet, a sufficient length to secure three standard width furniture pieces as a continuous unit, should be appropriate for general purpose use. Alternatively, the length could be ⅓ that discussed above when the device is intended for use with a single furniture piece. To further assist in the installation, a bubble level 19 is secured on the outer surface of the first leg 3. The installer may use the level 19 to level the furniture and apparatus during installation. While the bubble level 19 is disclosed as being secured to the upper surface of the first leg 3, the bubble level 19 could be secured at a variety of locations without departing from the spirit of the present invention.

The spacing between the furniture and the wall depends upon specific applications, but a nominal depth of 3½ to 4 inches should provide a sufficient variable distance spacing from the wall to accommodate floor moldings (for example, baseboard molding, quarter round, etc.) and wall moldings (for example, chair rail molding, picture boxes, etc.) of various thicknesses, while still providing enough surface area to securely fasten the apparatus to the furniture. As such, the first leg 3 is preferably formed with a width of 3½ to 4 inches. The surface area formed by the first leg 3 prevents objects from falling behind the furniture, thereby eliminating the need to disassemble the installation to retrieve an object every time an object falls off the back of the furniture.

Figure 2:
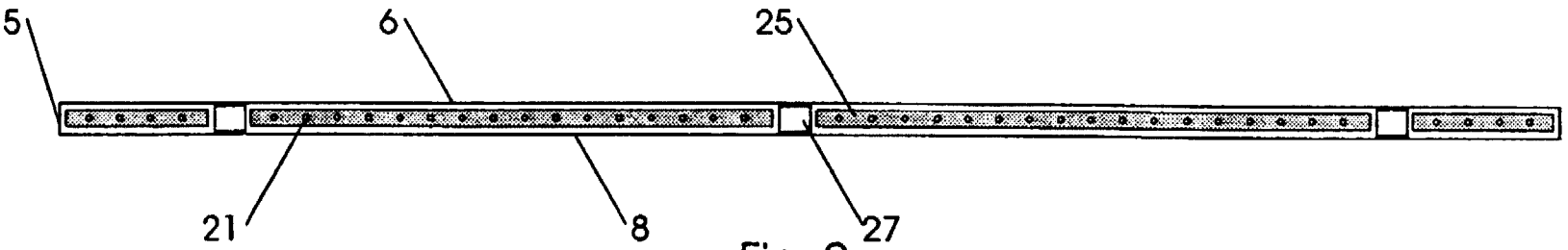
FIG. 2 is rear view of the apparatus, showing the surface area which will contact the vertical surface to which the apparatus is attached.
Figure 3:
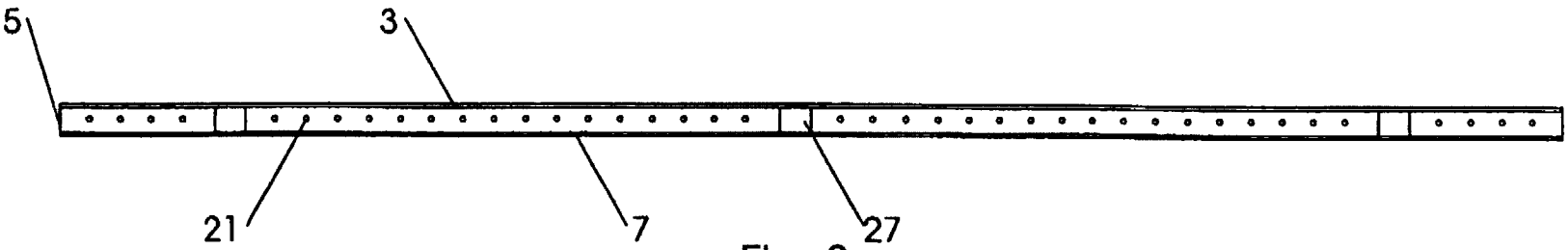
FIG. 3 is a front view of the securing apparatus.

With reference to FIG. 2, the second leg 5 is provided with a plurality of evenly spaced holes 21 similar to those found on the first leg 3. The holes 21 are aligned parallel to the longitudinal axis of the second leg 5, such that each hole 21 in the second leg 5 is axially aligned with a hole 9 in the first leg 3.

Figure 5:
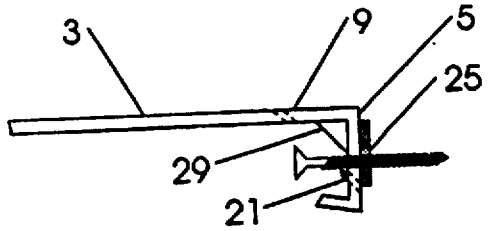
FIG. 5 is a cross sectional view of the securing apparatus along the line IV—IV in FIG. 1, showing a fastening device and adhesive backing provided with the apparatus using an alternate installation method from that depicted in FIG. 4.
Figure 6:
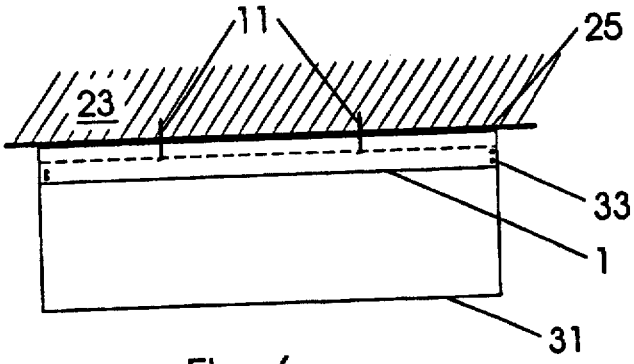
FIG. 6 is a top view showing the securing apparatus secured to a piece of furniture and a vertical support surface.
Figure 8:
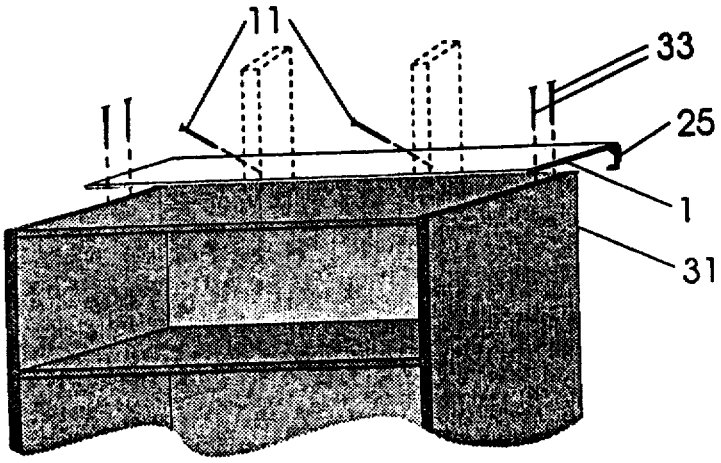
FIG. 8 is a perspective view showing the securing apparatus secured to a piece of furniture and a vertical surface with wall studs depicted behind the vertical surface of the wallboard.
Figure 7:
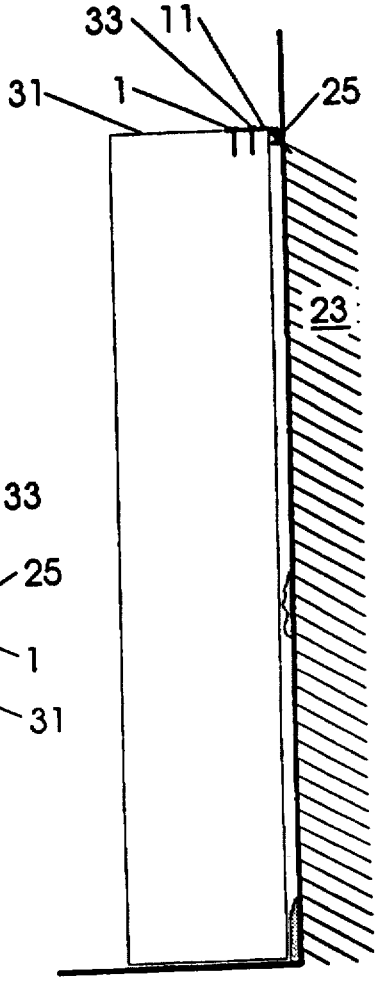
FIG. 7 is a side view showing the securing apparatus secured to a piece of furniture and a vertical support surface.

The holes 21 in the second leg 5 pass through the second leg 5 at approximately a 45 degree angle with respect to the plane of the second leg 5. Therefore, as seen in FIG. 4, a fastening device 11 (for example, a nail) may simultaneously pass directly through a hole 9 in the first leg 3 and a hole 21 in second leg 5 which is axially aligned with the hole 9 in the first leg 3. The nail then passes into the vertical surface 23, preferably a stud in a wall, to secure the apparatus to the surface. During installation, as shown in FIGS. 6, 7 and 8, several nails 11, positioned at strategic locations, are used to secure the apparatus to the vertical wall 23. This reduces the potential for structural failure of the wall. The installer might optionally choose to drive several nails, self tapping screws, or drywall anchors through the second leg only, as seen in FIG. 5, or through several holes 21 in the second leg 5 only, eliminating the need for the holes 9 in the first leg 3 in that particular installation. The installation decision depends on the specific wall and furniture.

To further assist in installation, the second leg 5 includes an adhesive backing 25 on the outer surface 12 of the second leg 5. During installation the adhesive contacts the vertical wall to temporarily mount the apparatus 1 to the desired surface. Specifically, once the user has cut the apparatus 1 to the desired length and positioned it in the desired location, the adhesive holds the apparatus 1 in place. The installer can then work with both hands to permanently secure the apparatus 1 to the vertical surface.

A plurality of grooves 27, preferably having a "V" shape as seen in FIG. 1, are cut into the elongated member 10. The grooves 27, which are cut at moderately spaced intervals, serve as a passageway for electrical cords. Specifically, the grooves 27 permit the passage of electrical cords, and the like, between the back of the furniture and the wall to which the securing apparatus is attached. In the event that an installer wishes to pass a thicker cord, or several cords, through a single groove, the installer may simply enlarge a specific groove using a sharp household tool. FIG. 1 shows how the grooves 21 are cut partially into the first leg 3. Similarly, the grooves 27 are partially cut into the projection 7 (not shown). As seen in FIG. 2, the grooves 27 pass from the first longitudinal edge 6 of the second leg 5 to the second longitudinal edge 8 of the second leg 5. Because only a fraction of the first leg 3 is cut away to form a groove 27, the first leg 3 has a large horizontal surface area when installed.

In addition, the apparatus 1 is provided with a series of reinforcing members 29 positioned between the first leg 3 and the second leg 5 (see FIGS. 4 and 5). The reinforcing members 29 help to maintain the structural stability of the apparatus 1.

With reference to FIGS. 6, 7 and 8, the simple design of the furniture securing apparatus 1 provides for a simple installation. A single person can install the apparatus with minimal effort. The installer first decides upon the desired furniture installation location. With the furniture 31 in place, the installer then measures the required length of the apparatus 1. The installer may use the scales 13 to readily determine the appropriate length of the elongated member 10 that is required for the application. Using an appropriate cutting instrument, the installer cuts the elongated member 10 to the required length. Also, anticipating the need for larger "V-shaped" cord grooves 27, larger than those provided with a standard apparatus, the installer may increase the size of the grooves 27 using an appropriate cutting instrument, without detracting from the effectiveness of the apparatus 1.

The installer next uses the bubble level 19 to level the furniture 31 and the installation location of the apparatus 1. With the furniture in place, and/or with the desired apparatus 1 installation location noted, the installer temporarily secures the apparatus to the wall surface 23 using the adhesive backing 25 on the outer surface 12 of the second leg 5. This allows the installer to move the furniture 31, while working to permanently fasten the apparatus 1 to the wall. After moving the furniture 31 away from the wall, the installer drives the required number of nails 11, or similar fastening devices, through the holes 9, 21 in the first leg 3 and the second leg 5 to secure the apparatus 1 to the wall. It should be understood that the installer only needs to move the furniture when the installation method shown in FIG. 5 is utilized. When the method shown in FIG. 4 is utilized, the installer may, or may not, move the furniture depending on the specific circumstances.

Finally, the installer positions the furniture 31 in its proper location. Alternatively, the installer can permanently install the device in place, using the technique shown in FIG. 4, without moving the furniture. Preferably, the installer secures the furniture 31 to the apparatus 1 by positioning the top, back surface of the furniture 31 under the horizontal, first leg of the apparatus 1. The installer then drives a small fastening nail 33 through a hole of the horizontal, first leg 3 into a structurally sound support element of the installed furniture 31. If necessary, an installer may skip the use of a preformed hole in the first leg 3 and simply hammer the nail through the first leg 3 and into the piece of furniture. The installer must choose a structurally sound fastening location on the furniture in order to maximize the effectiveness and performance of the furniture securing apparatus. For example, the installer might use the upper ends of the side walls of a bookcase for attaching the apparatus to the bookcase.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. An apparatus for securing free standing structures to a support surface, comprising:

a J-shaped elongated body including a first leg, a second leg perpendicularly attached to the first leg, and means for spacing a free standing structure from a support surface, wherein the means for spacing includes a projection, perpendicularly attached to the second leg and generally parallel to the first leg such that the means for spacing forms a third leg of the J-shaped elongated body;

the first leg includes a first longitudinal axis and a plurality of holes through which a fastening device may pass;

the second leg includes a second longitudinal axis, an inner and outer surface, and a plurality of holes through which a fastening device may pass.

2. The apparatus according to claim 1, wherein the first leg further includes a linear measuring device.

3. The apparatus according to claim 2, wherein the linear measuring device is positioned parallel to the holes of the first leg.

4. The apparatus according to claim 1, wherein the first leg further includes a leveling element.

5. The apparatus according to claim 1, wherein the second leg further comprises a temporary attachment element on the outer surface thereof.

6. The apparatus according to claim 5, wherein the temporary attachment element is an adhesive.

7. The apparatus according to claim 1, wherein the plurality of holes in the first leg are evenly spaced along a line parallel to the first longitudinal axis and the plurality of holes in the second leg are evenly spaced along a line parallel to the second longitudinal axis.

8. The apparatus according to claim 1, wherein the plurality of holes in the first leg are aligned with the plurality of holes in the second leg such that a fastening device may pass through a hole in the first leg and a hole in the second leg which is aligned with the hole in the first leg.

9. The apparatus according to claim 1, wherein the plurality of holes in the first leg penetrate the first leg at a forty-five degree angle such that a fastening device passing therethrough is directed toward the second leg.

10. The apparatus according to claim 1, wherein the second leg further includes at least one groove cut therein, the at least one groove being substantially perpendicular to the second longitudinal axis.

11. The apparatus according to claim 1, wherein the plurality of holes in the first leg are angularly oriented with respect to a plane of the first leg and the plurality of holes in the second leg are angularly oriented with respect to a plane of the second leg such that a fastening device passing therethrough is directed through both the first leg and the second leg.

12. The apparatus according to claim 11, wherein the plurality of holes in the first leg penetrate the first leg at a forty-five degree angle and the plurality of holes in the second leg penetrate the second leg at a forty-five degree angle.

* * * * *